US006537156B1

(12) United States Patent
Stagg

(10) Patent No.: US 6,537,156 B1
(45) Date of Patent: Mar. 25, 2003

(54) BILLIARDS RACK AND ASSOCIATED METHODS OF PLAYING BILLIARDS

(76) Inventor: Glenn E. Stagg, 4392 Holland Rd., Suite 109, Virginia Beach, VA (US) 23452

( * ) Notice: Subject to any disclaimer, the term of this patent is extended or adjusted under 35 U.S.C. 154(b) by 0 days.

(21) Appl. No.: 09/389,470

(22) Filed: Sep. 3, 1999

(51) Int. Cl.[7] ..... A63D 15/00; A63F 9/24; G06F 17/00

(52) U.S. Cl. ..... 473/40; 473/1

(58) Field of Search ..... 473/1–18, 21, 473/40–41, 33, 52; 273/274, 125 R; 108/150; 206/315.9, 486, 490, 378, 233, 575, 579, 224; 211/14

(56) References Cited

U.S. PATENT DOCUMENTS 1,187,243 A * 6/1916 Bernstein ..... 473/41
3,488,054 A * 1/1970 Brzoska ..... 473/17
3,618,944 A * 11/1971 Myers ..... 473/41
3,825,258 A * 7/1974 Frierman ..... 473/41
4,103,773 A * 8/1978 Haber ..... 473/41
4,307,881 A * 12/1981 Jaworski ..... 473/40
4,452,450 A * 6/1984 Cayton ..... 473/40
4,984,788 A * 1/1991 Harriman ..... 473/41
5,100,324 A * 3/1992 Slayton ..... 206/575

* cited by examiner

*Primary Examiner*—Paul T. Sewell
*Assistant Examiner*—Mitra Aryanpour
(74) *Attorney, Agent, or Firm*—Merek, Blackmon & Voorhees, LLC

(57) ABSTRACT

Novel set up racks and games for billiards. The racks set up object balls in arrays wherein the object balls are spaced apart from one another. The arrays are straight, circular, and cruciform. Games played employing the novel arrays may be generally conventional, but add novel steps. One step is that of avoiding touching object balls with the cue ball other than that object ball being projected into a table pocket. Another novel step is that of requiring that the cue ball not cross over a line of object balls. An alternative novel step requires that the cue ball touch opposite sides of the line of object balls on alternate shots. Novel steps employing the circular array include maintaining the cue ball selectively inside or outside the circular array, or alternatively requiring that the cue ball alternate between coming to rest inside and outside the circular array.

3 Claims, 5 Drawing Sheets

BILLIARDS RACK AND ASSOCIATED METHODS OF PLAYING BILLIARDS

BACKGROUND OF THE INVENTION

1. Field of the Invention

The present invention relates to a billiards rack for setting up balls in unconventional arrays wherein the billiard balls do not touch one another, and to billiard games utilizing the unconventional arrays.

2. Description of the Prior Art

In conventional billiard games, a player starts by projecting the cue ball into a triangular array of object balls. The player then attempts to strike the object balls with the cue ball such that the object balls enter the pockets, and are withdrawn from play. The act of striking the initial array usually results in a scattered, random array of object balls over the playing surface. The effort to "sink" an object ball, or force the object ball into a pocket, varies with each object ball due to distance from the cue ball, and proximity to other object balls and to side walls of the billiard table.

Game apparatus has been proposed in the prior art which varies the initial array from the usual triangular array in which each object ball contacts at least two other object balls. U.S. Pat. No. 3,618,944, issued to Myers on Nov. 9, 1971, sets forth a billiards rack which locates object balls in a spaced apart cruciform array. The apparatus is unlike two of the racks of the present invention, which two are respectively straight and circular. Also, novel steps or methods of play which may be practiced with a circular novel rack do not lend themselves to the cruciform rack of Myers.

U.S. Pat. No. 3,399,890, issued to Galedrige on Sep. 3, 1968, also shows a cruciform array. However, the balls in the cruciform array of Galedrige touch other balls, unlike those in the present invention. This has the effect of preventing certain steps or methods of play which are practiced in the present invention.

Unconventional set up arrays are also shown in U.S. Pat. No. 4,984,788, issued to Harriman on Jan. 15, 1991, and U.S. Pat. No. 4,307,881, issued to Jaworski on Dec. 29, 1981. In this group, the arrays are not-linear or circular, as taught in the present invention. Also, the balls of the arrays of Harriman and Jaworski touch other balls, unlike the present invention.

None of the above inventions and patents, taken either singly or in combination, is seen to describe the instant invention as claimed.

SUMMARY OF THE INVENTION

The present invention artificially creates certain arrays of object balls for billiards games which require certain skills on the part of the players. These arrays are only rarely encountered in conventional games, and even then not to the degree afforded in the present invention. Notably, object balls are arrayed in regular intervals spaced apart from each other. Billiard games that entail special rules may be played with the novel arrays of object balls.

In three variations each having an associated non-conventional game, the arrays are linear, circular, and cruciform. The object of each game is to project a selected object ball into one of the usual pockets without touching adjacent object balls. If an adjacent ball is touched, the player's turn is terminated.

Preferably, the cue ball is placed anywhere on the playing surface at the player's discretion, except in those games wherein placement is at least partially predetermined. The player then selects one object ball and attempts to project it into a pocket. When utilizing the circular array, it is possible to create variations of play by requiring in the game that the cue ball be initially located within the circle. Alternatively, the cue ball may be initially located outside the circle. It may then be required that the cue ball always remain either inside or outside the circle, as the players arbitrarily select. When utilizing the linear array, rules may be arbitrarily selected requiring the cue ball to remain on one side of the line, or alternatively that the cue ball alternately cross the line for each succeeding shot. Similar special rules may be adopted for use with the cruciform array.

In further variations applicable to any of the selected arrays, the initial array set up may be placed wherever the players wish. Proximity to one or more pockets will be arbitrarily determined, and hence those pockets can be eliminated from an active role in the game as a consequence of placement of the array.

It is contemplated that special skills involving shot placement and shot type will be called upon with much greater frequency than would naturally occur in conventional billiards. For example, maintaining the cue ball on one side of a row of object balls, the row being either straight or curved, may require emphasized utilization of backspin. Similar tactics or other specialized ball control tactics may be called for given the arbitrary constraints of the novel games. These requirements afford players an opportunity to practice or play with great frequency types of shots which would normally not arise in conventional billiards, although it will be apparent to those familiar with billiards that the novel set up apparatus can be adapted to otherwise conventional games. Additional challenges posed by the novel set up array and rules of play, and perception of slight differences in angular relationships can impart additional dimensions and renewed interest to the game of billiards.

Accordingly, it is a principal object of the invention to provide game apparatus enabling new methods of playing billiards.

It is another object of the invention that the new methods of play require control over contact of a cue ball with object balls.

It is a further object of the invention to limit where the cue ball is allowed to engage the playing surface.

Still another object of the invention is that the novel methods be compatible with conventional billiards games.

An additional object of the invention is to provide a variety of initial object ball arrays.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
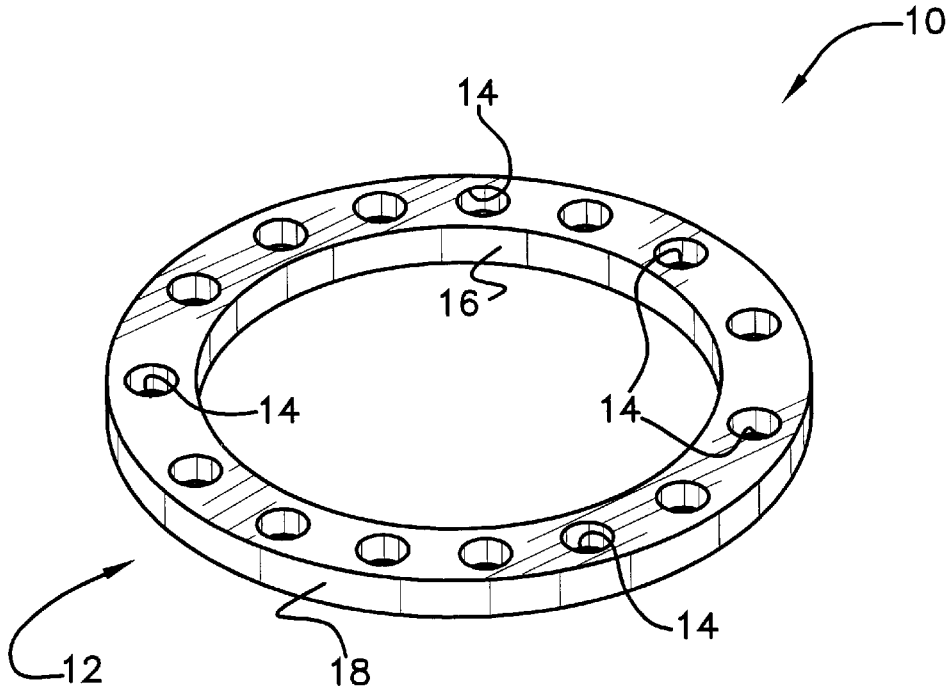
FIGS. 1, 2, and 3 are perspective views of three respective embodiments of a novel billiards rack for setting up object balls on a playing surface of a billiards table.

FIG. 1 of the drawings shows a billiards rack 10 for setting up billiard balls (not shown) in a predetermined array on a playing surface (not shown). Rack 10 comprises a circular ball receiving member 12 having a plurality of openings 14 formed therein for receiving billiard balls and securing the billiard balls each in a stationary location on and in contact with the playing surface. Openings 14 form a circular array. Any number of openings 14 may be provided, but fifteen is a preferred number, so that rack 10 accepts a standard number of object billiard balls. Each opening 14 is dimensioned and configured to receive one billiard ball, and is preferably two and one quarter inches (5.7 cm) in diameter, and to secure the billiard ball in a stationary location on and in contact with the playing surface.

Each opening is spaced apart from every other opening, preferably at spacing intervals of one and five eighths inches (3.7 cm) between adjacent openings 14. The overall diameter of rack 10, which preferably is circular in outer configuration, is preferably twenty-one and one half inches (48 cm) in diameter. Preferably, the inside of rack 10 is open, the circle described by interior surface 16 being fifteen and one quarter inches (34 cm) in diameter. Each opening 14 is spaced outside internal surface 16 by five eighths of an inch and is spaced inside external surface 18 by an equal distance. Rack 10 is preferably three quarters of an inch thick, and may be fabricated from wood, plastic, or any other suitable material.

Figure 2:
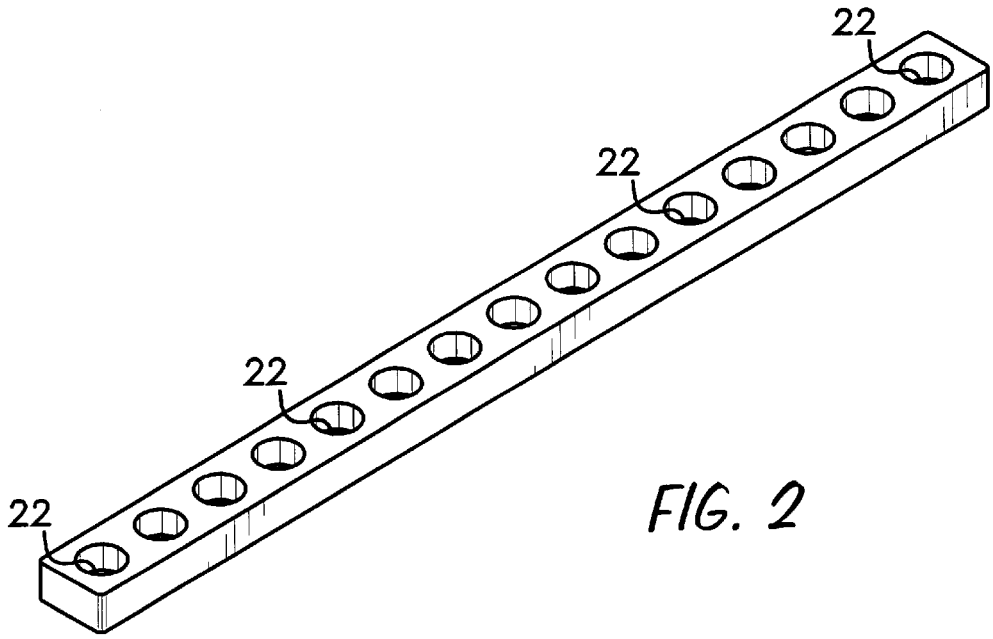

FIG. 2 illustrates a second billiard ball rack 20, wherein fifteen openings 22 are configured in a straight array. Rack 20 is preferably thirty-eight and three quarters inches (98 cm) long, three and one half inches (9 cm) wide, and three quarters of an inch (2 cm) thick. Openings 22 are two and one quarter inches in diameter, and are spaced apart from one another at intervals of five eighths (1.6 cm) of an inch.

Figure 3:
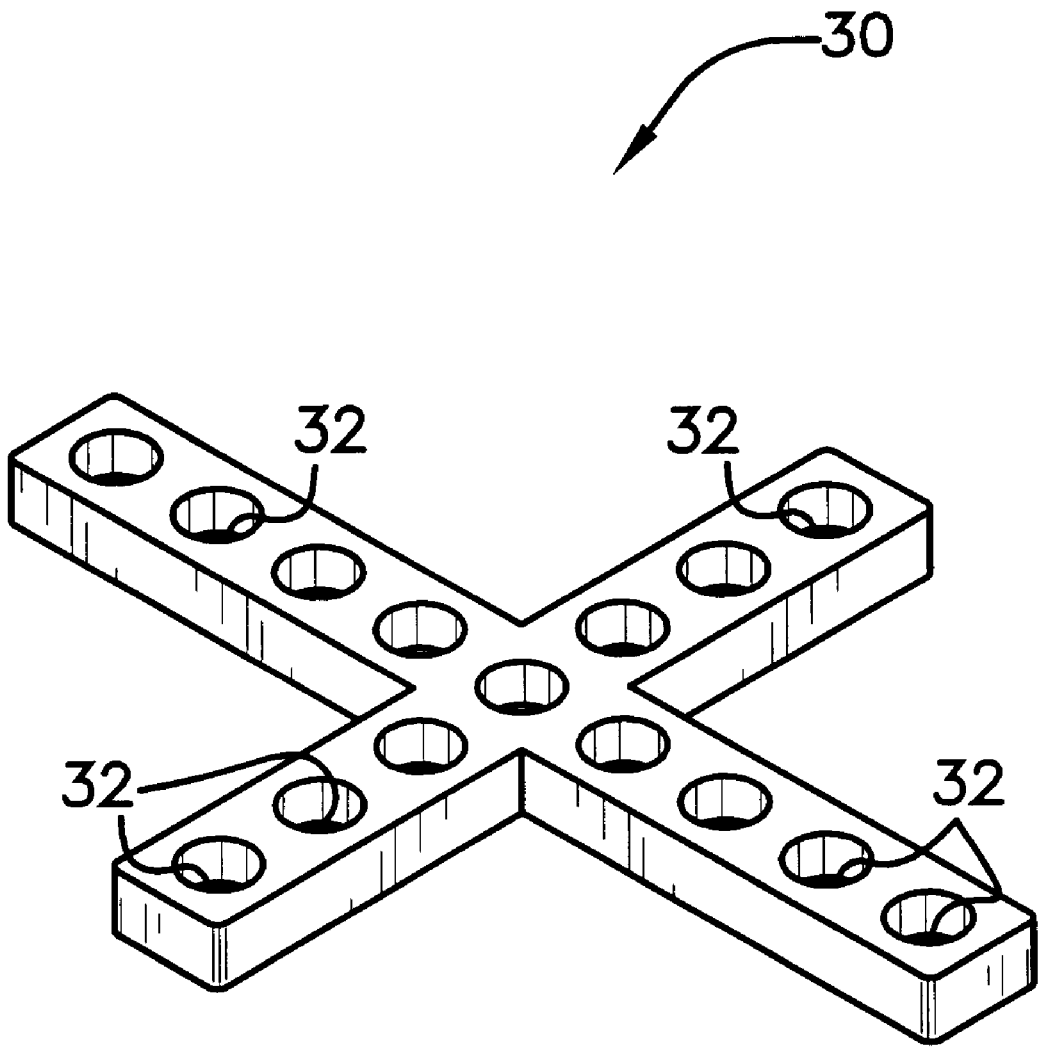

FIG. 3 illustrates a third billiard ball rack 30, wherein fifteen openings 32 are configured in a cruciform array. Dimensions and spacing of openings 32 are preferably equivalent to those of one of the prior described embodiments.

Figure 4:
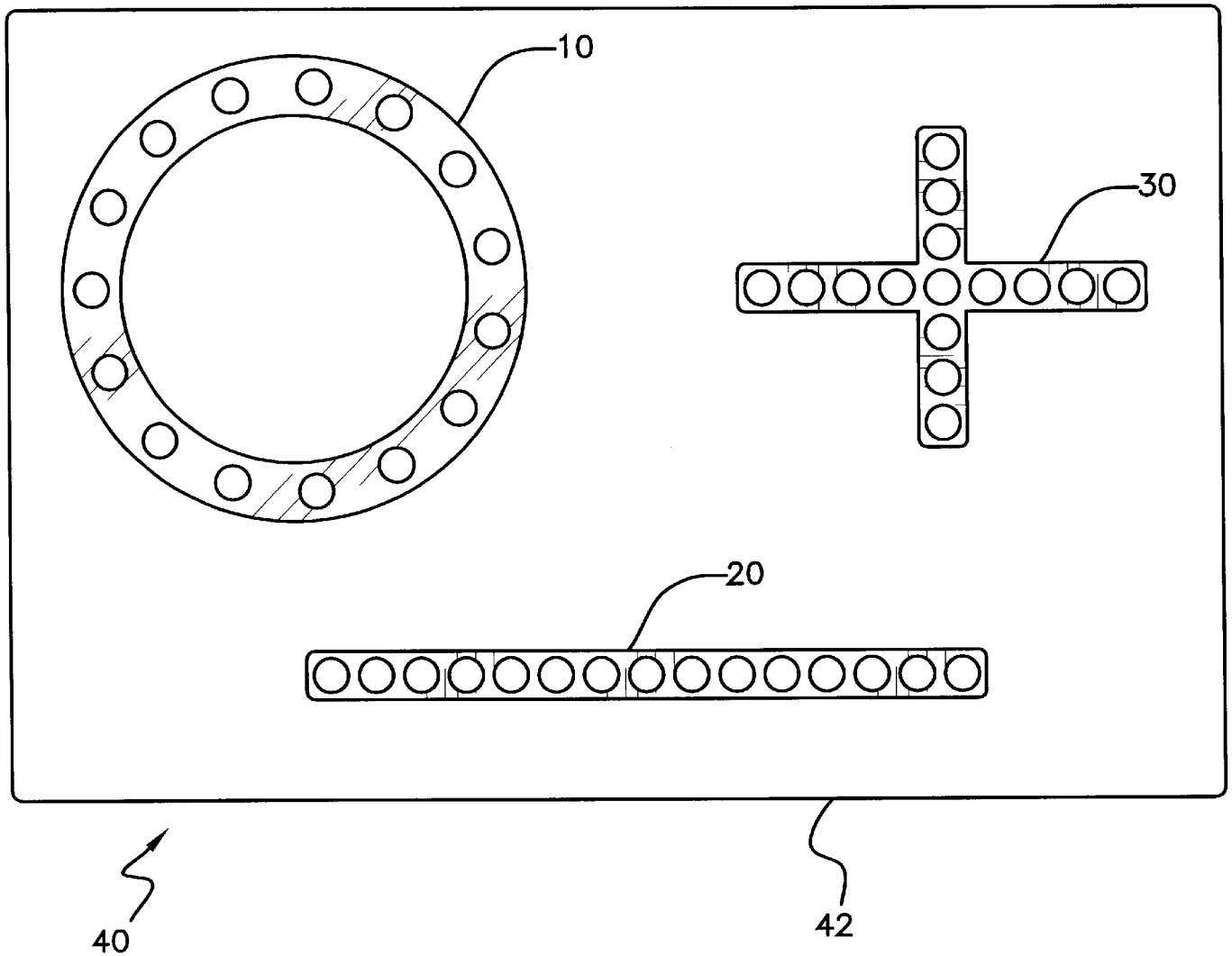
FIG. 4 is a diagrammatic, top plan view of the billiards racks of FIGS. 1–3 configured as an enclosed kit.

Billiard racks 10, 20, 30 are preferably provided for retail distribution as a kit 40, as seen in FIG. 4. Kit 40 enables users to engage in new games by enabling the user to set up billiard balls in diverse predetermined arrays on a playing surface. To this end, kit 40 comprises first ball receiving member 10 configured such that the object balls are set up in a circular array, second ball receiving member 20 establishing a straight array, and third ball receiving member 30 establishing a cruciform array. In each array, the object balls are spaced apart from one another in a linear pattern. Each ball receiving member 10, 20, or 30 has openings accommodating fifteen object balls, so that the number of balls in play is conventional, although obviously the number of balls in play could be varied to be more or less than fifteen. Kit 40 includes a suitable enclosure 42, such as a cardboard box, a leather bound carrying case, or the like (no specific examples are shown) enabling components of kit 40 to be displayed for retail distribution and to be carried conveniently by a user.

Methods of playing games of billiards employing a conventional table (not shown) having pockets and a playing surface, a cue ball, and a plurality of object balls are made possible by the apparatus described above. The ultimate goal of driving each object ball into a pocket is intuitively realized by those familiar with billiards. However, players are afforded in the following novel game methods an opportunity to practice types of shots infrequently encountered in conventional games. The novel steps may be practiced with or without incorporating conventional features of billiards play to introduce additional dimensions thereto.

Figure 5:
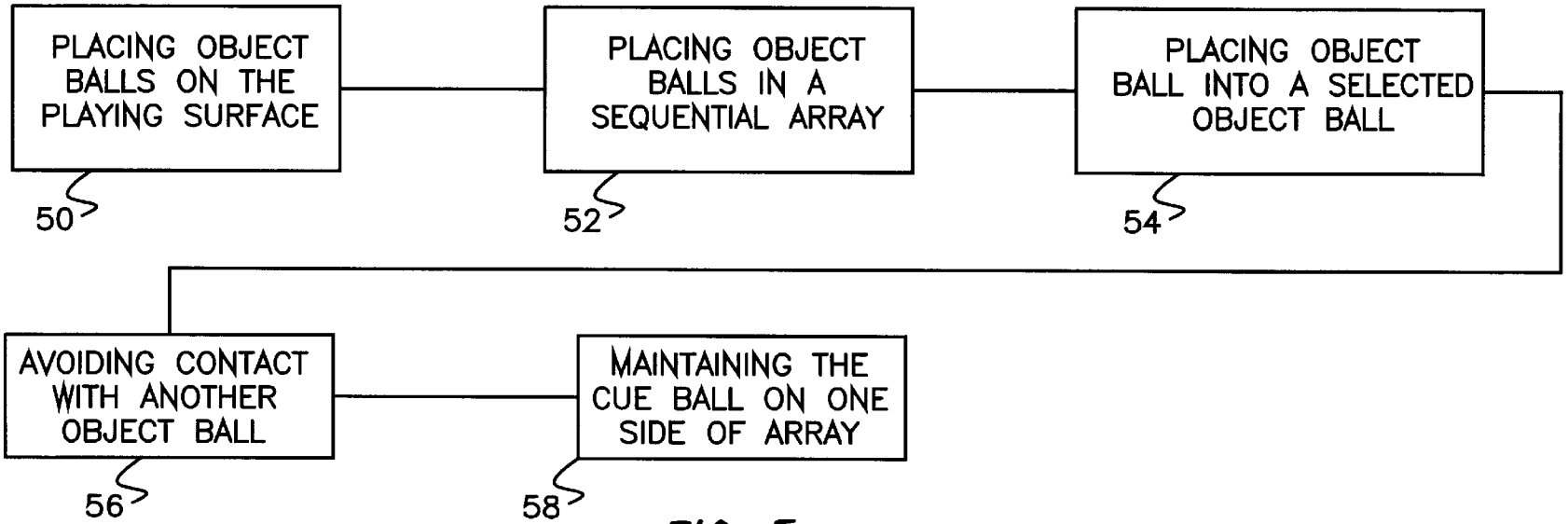
FIG. 5 is a block diagram of a method of play employing the novel apparatus, and is read from left to right.

In a first exemplary game, and referring now to FIG. 5, conventional object balls (not shown) are set up on any desired playing surface, but preferably on that of a conventional billiards table (not shown) in an array generated by the novel apparatus. Specifically, step 50 is that of placing the object balls on the playing surface in an array wherein each object ball is spaced apart from every other object ball. Step 50 is preferably but not necessarily modified by practicing a step 52 of placing the object balls in a sequential array, such as the circular array of rack 10 or the straight array of rack 20, or even the compound straight array of rack 30.

Play is commenced in a step 54 of projecting the cue ball into a selected object ball while attempting to drive the selected object ball into one of the pockets. A player must exert skill to drive a single selected object as desired, without the usual random scattering of object balls placed in abutment. A novel aspect of the novel game method is that of practicing step 56, that of attempting to avoid causing the cue ball to strike any object ball other than the selected object ball. In one embodiment of novel play, the step 54 of projecting the cue ball into a selected object ball comprises a further step 58 of maintaining the cue ball on one side of the sequential array of object balls. In other respects, play may be conventional, with the player striving to drive the object balls successively into the pockets of the billiards table until none remain on the playing surface.

Figure 6:
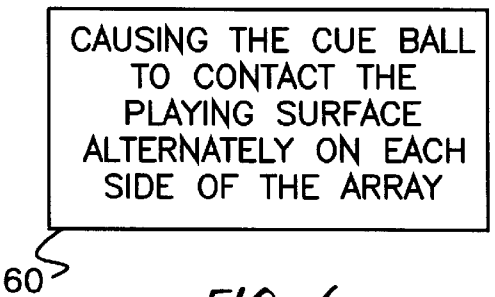
FIG. 6 is a block diagram showing an alternative step which modifies the method shown in FIG. 5.

The method of FIG. 5 may be modified by deleting step 58 in favor of a step 60 (see FIG. 6) of causing the cue ball to contact the playing surface alternately on each side of the sequential array of object balls each time the cue ball is projected into an object ball. Step 58 requires control over spin of the cue ball, known as reverse or bottom English. Step 60 requires control known as top English. By adhering to either step 58 or step 60 consistently during play, the player may gain improved, more precise skills in the techniques of such spin control.

Figure 7:
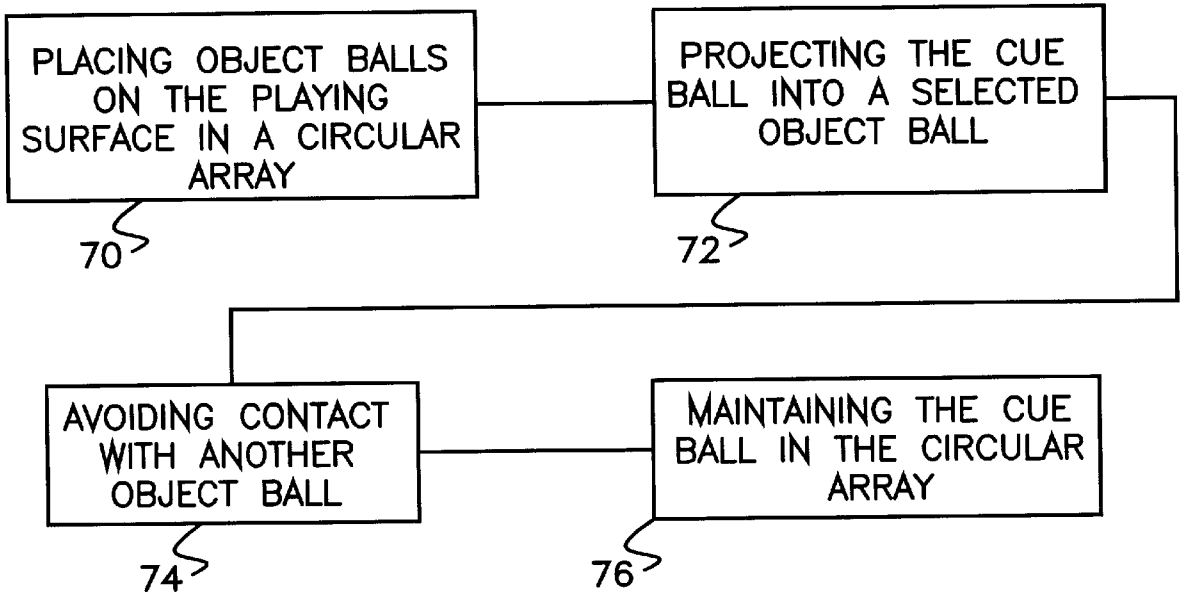
FIG. 7 is a block diagram of an alternative method of play employing the novel apparatus.
Figure 8:
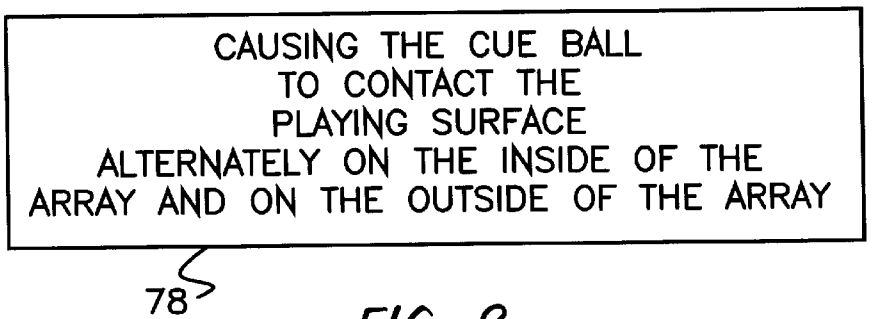
FIG. 8 is a block diagram showing an alternative step which modifies the method of FIG. 7.

An alternative yet related method of play is shown in FIG. 7. In the method of FIG. 7, a first step 70 of placing the object balls on the playing surface in a circular array wherein each object ball is spaced apart from every other object ball, a second step 72 of projecting the cue ball into a selected object ball while attempting to drive the selected object ball into one of the pockets, and a third step 74 of attempting to avoid causing the cue ball to strike any object ball other than the selected object ball are similar to steps 50, 52, and 54 of the method of play of FIG. 5. However, the method of FIG. 7 differs from that of FIG. 5 in that it includes a step 76 of maintaining the cue ball within the circular array when the cue ball is in play.

In an alternative embodiment, step 76 of maintaining the cue ball within the array is replaced by a step 78 of causing the cue ball to contact the playing surface alternately on the inside of the circular array and on the outside of the circular array of object balls each time the cue ball is projected into an object ball.

It is to be understood that the present invention is not limited to the embodiments described-above, but encompasses any and all embodiments within the scope of the following claims.

I claim:

1. A billiard apparatus for racking a plurality of billiard balls into an annular ring array on a playing surface, said billiard apparatus comprising:

a first ring shaped ball receiving member having an inner surface defining a large central opening, and an outer surface, a plurality of discrete ball receiving circular openings spaced about said ball receiving member intermediate said inner and outer surfaces;

each said circular opening having a diameter greater than the billiard balls and being dimensioned and configured to receive one of the billiard balls therein to securely locate the billiard ball in a predetermined location;

said central opening being substantially larger than said circular openings and being at least greater than twice the diameter of a billiard ball to distinguish said central opening from said ball receiving circular openings;

said circular openings positioned in a predetermined ring-shaped array for separating and positioning the billiard balls whereby when the ball receiving member is removed, the billiard balls are spaced apart from each other billiard ball and positioned substantially in a ring shaped array.

2. The billiard apparatus of claim 1 wherein ring shaped ball receiving member is formed as an open ring.

3. A billiard apparatus for racking a plurality of billiard balls into an annular ring array on a playing surface, said billiard apparatus consisting of:

a first ring shaped ball receiving member having an inner surface defining a large central opening, and an outer surface, a plurality of discrete ball receiving circular openings spaced about said ball receiving member intermediate said inner and outer surfaces;

each said circular opening having a diameter greater than the billiard balls and being dimensioned and configured to receive one of the billiard balls therein to securely locate the billiard ball in a predetermined location;

said central opening being substantially larger than said circular openings and being at least greater than twice the diameter of a billiard ball to distinguish said central opening from said ball receiving circular openings;

said circular openings positioned in a predetermined ring-shaped array for separating and positioning the billiard balls whereby when the ball receiving member is removed, the billiard balls are spaced apart from each other billiard ball and positioned substantially in a ring shaped array.

* * * * *